United States Patent [19]

Lee et al.

[11] Patent Number: 4,735,136

[45] Date of Patent: Apr. 5, 1988

[54] FULL RECEPTACLE INDICATOR FOR COMPACTOR

[75] Inventors: Kenneth M. Lee, Lincoln County, Ky.; Paul B. Chesnut, Armstrong Township, Vanderburgh County, Ind.

[73] Assignee: Whirlpool Corporation, Benton Harbor, Mich.

[21] Appl. No.: 945,681

[22] Filed: Dec. 23, 1986

[51] Int. Cl.[4] ..... B30B 15/22

[52] U.S. Cl. ..... 100/52; 100/53; 100/99; 100/229 A; 100/256

[58] Field of Search ..... 100/52, 53, 99, 229 A, 100/256, 289, 51

[56] References Cited

U.S. PATENT DOCUMENTS

| | | | |
|---|---|---|---|
| 3,368,478 | 9/1965 | Clar . | |
| 3,608,476 | 9/1971 | Price . | |
| 3,613,560 | 10/1971 | Bottas et al. . | |
| 3,629,608 | 12/1971 | Trindle . | |
| 3,687,063 | 8/1972 | Clar . | |
| 3,720,844 | 3/1973 | Sahs . | |
| 3,765,147 | 10/1973 | Ippolito et al. . | |
| 3,785,278 | 1/1974 | Hopkins . | |
| 3,787,830 | 1/1974 | Cato et al. . | |
| 3,822,638 | 7/1974 | Merkin . | |
| 3,831,513 | 8/1974 | Tashman . | |
| 3,845,707 | 11/1974 | Enright et al. . | |
| 3,855,919 | 12/1974 | Potter . | |
| 3,861,296 | 1/1975 | Clar . | |
| 3,901,139 | 8/1975 | Moriconi . | |
| 3,918,359 | 11/1975 | Hennells et al. . | |
| 4,007,677 | 2/1977 | Fox . | |
| 4,044,664 | 8/1977 | Budoff . | |
| 4,054,087 | 10/1977 | Choate et al. . | |
| 4,062,282 | 12/1977 | Miller et al. . | |
| 4,073,228 | 2/1978 | Henzl . | |
| 4,113,079 | 9/1978 | Wright | 100/53 X |
| 4,205,603 | 6/1980 | Baker, Jr. | 100/53 X |
| 4,267,462 | 5/1981 | Frisbie | 100/52 X |

*Primary Examiner*—Andrew M. Falik

*Attorney, Agent, or Firm*—Lowe, Price, Leblanc, Becker & Shur

[57] ABSTRACT

In a refuse compactor wherein refuse in a disposable bag within a receptacle is compacted by a ram driven by a reversible electric motor, a "full bag" indicator lamp is energized when the refuse compacted in the receptacle is at a predetermined level. The motor drives the ram downward into the receptacle to compact the refuse, and when the ram slows in response to the reactive load of the refuse, a centrifugal switch reverses the direction of the motor to return the ram to a rest position above the receptacle. The bag is diagnosed full to energize the indicator lamp if the ram is at a predetermined level in the receptacle when the motor reverses. The indicator lamp is controlled by a latching relay that requires only one pair of contacts to energize and latch on the lamp.

12 Claims, 3 Drawing Sheets

FULL RECEPTACLE INDICATOR FOR COMPACTOR

TECHNICAL FIELD

This invention relates generally to refuse compactors, and particularly to a display for indicating a full condition of a household compactor.

BACKGROUND OF THE INVENTION

A conventional type of household compactor has a ram that is positioned within a cabinet above a receptacle containing refuse to be compacted. During a cycle of operation, an electric motor drives the ram downward into the receptacle to compact refuse therein and then returns the ram to its rest position above the receptacle. The motor is controlled by a number of electrically interlocking switches and relays to move the ram during a refuse compaction cycle and protect the user from injury by the ram. For example, the motor is deenergized automatically if the receptacle is opened or tilted, or if the ram reaches its rest position at the completion of a compaction cycle. The direction of rotation of the motor reverses automatically to reverse the direction of movement of the ram following compaction of the refuse or upon a jam, detected by a centrifugal switch mechanically coupled to the motor, to return the ram to the rest position.

The refuse is generally contained in a disposable bag within the receptacle to be discarded when the bag becomes filled to its capacity. Because the interior of the receptacle of the compactor is not readily viewed, however, it is not convenient for the user to determine when the refuse bag should be removed and replaced. Even as the interior of the receptacle is viewed by the user as he or she slides the receptacle open prior to a compaction cycle, it cannot be determined by visual inspection whether the bag should be replaced prior to the next compaction cycle because the refuse added has not yet been compressed. It accordingly is desirable to provide a display to indicate whether the refuse bag of a compactor is full without requiring visual inspection of the bag by the user.

Apparatus in the prior art for providing a "full bag" indicator require the addition of multiple electrical components and therefore add excessively to the cost of the compactor. For example, in U.S. Pat. No. 3,831,513 to Tashman, a limit switch extending downward on a pipe from an upper surface of an industrial compactor contacts an abutment member on the ram when the ram is extended downward to a position corresponding to a full condition of the receptacle. The reactive pressure of refuse in the receptacle against the ram is detected by a centrifugal switch coupled to the motor that closes when the speed of the motor is reduced below about 1375 rpm as the ram compresses the refuse. If the limit switch is closed when the direction of the ram reverses in response to reactive pressure of the refuse in the receptacle, the receptacle is determined to be full. A relay having its actuator coil in series with the limit switch and centrifugal switch closes to energize a "full compactor" indicator lamp when both switches are closed simultaneously.

An additional pair of contacts of the indicator lamp relay, when the contacts are closed, electrically bypasses the limit switch and centrifugal switch to latch the indicator lamp on until the compactor is emptied and the relay reset.

This system, although effective to turn on the "full compactor" lamp when the receptacle of the compactor is full of refuse, requires in addition to standard compactor control circuitry as well as a downwardly extending limit switch and its suspension hardware, a further pair of relay contacts together with associated wiring for latching the indicator lamp on, and accordingly, is too costly for incorporation as a "full bag" indicator in a household compactor.

It is therefore an object of this invention to provide a "full bag" indicator for a compactor that is less expensive than indicators of the prior art.

Another object of the invention is to provide a "full bag" indicator for a compactor that uses a minimum number of additional parts and is easily installed during manufacture of the compactor.

Another object is to provide a "full bag" indicator for a compactor that uses existing electrical components for controlling the compactor to detect a full bag.

A further object of the invention is to provide a "full bag" indicator for a compactor that uses a mininum number of electrical components to maximize the reliability of the indicator.

SUMMARY OF THE INVENTION

The above and other objects of the invention are satisfied by a full bag indicator for a compactor that comprises an indicator lamp energized by a relay connected electrically in series with a limit switch and a centrifugal switch coupled to a reversible motor within the compactor. The limit switch is located in a position on a wall of the cabinet to be closed by a ram when the ram is extended by the motor into a receptacle to a level corresponding to a full refuse bag. The centrifugal switch closes when the speed of the motor slows under the reactive force of the refuse as the refuse is compacted by the ram, to reverse the motor and return the ram to its rest position above the receptacle. The indicator lamp thus is energized when the direction of movement of the ram is reversed at the time that the ram is in a "full bag" position within the receptacle.

Latching circuitry latches the indicator lamp on when the lamp is energized by simultaneous closure of the limit switch and centrifugal switch to indicate a full bag condition of the receptacle. In one embodiment of the invention, the latching circuitry includes an additional pair of switch contacts of the lamp relay that, when closed, electrically bypasses the limit switch and centrifugal switch to maintain the lamp on. In another embodiment, the lamp relay contacts are connected electrically in series, and the lamp is connected electrically in parallel, with the actuator coil of the lamp relay for latching.

Still other objects and advantages of the present invention will become readily apparent to those skilled in this art from the following detailed description, wherein only the preferred embodiment of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DETAILED DESCRIPTION OF THE PREFERRED EMBODIMENTS

Figure 1:
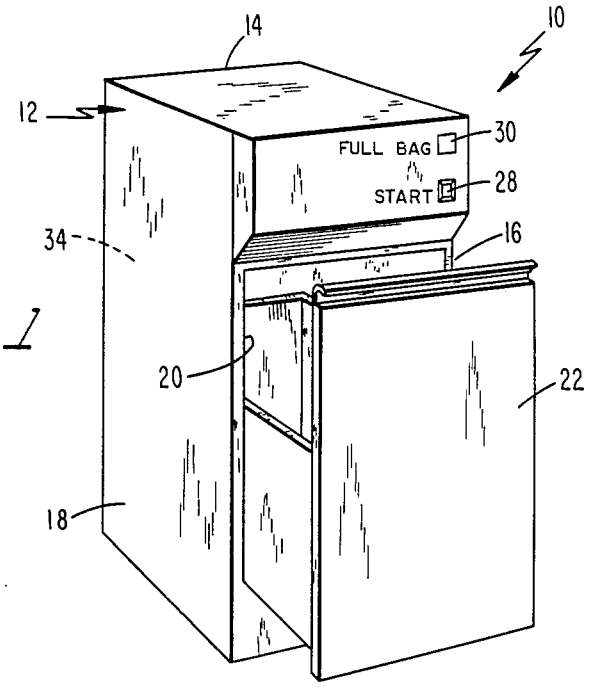
FIG. 1 is a perspective view of a refuse compactor having a "full bag" indicator incorporating the principles of the invention.
Figure 2:
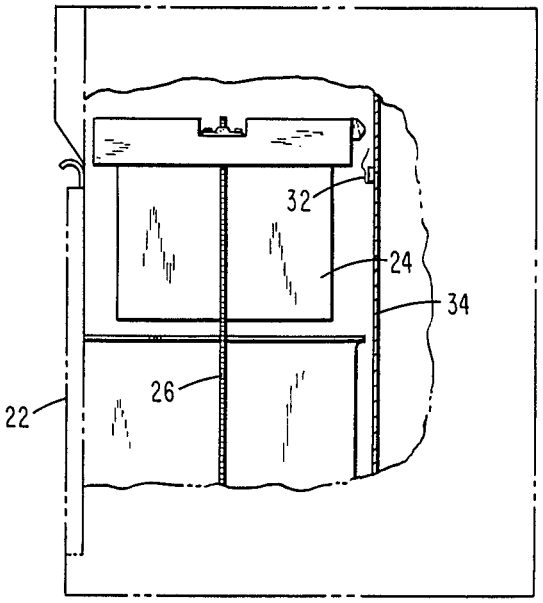
FIG. 2 is a side view of the refuse compactor with a portion broken away to expose the ram, refuse receptacle and limit switch arranged in accordance with an aspect of the invention.

With reference to FIGS. 1 and 2, a refuse compactor 10 incorporating the invention comprises a cabinet 12 having a top surface 14 and opposite sidewalls 16, 18 defining an access opening 20 for receiving a movable receptacle 22, and a rear wall 34. The receptacle 22 may be provided with a disposable bag (not shown) to hold refuse to be compacted. A ram 24, within the cabinet 12 of the compactor is mounted on drive screws 26 on opposite sides of the receptacle (only one drive screw 26 is shown in FIG. 2), and is normally maintained in a "rest" position above the receptacle 22 when the compactor is not carrying out a refuse compaction cycle of operation.

To compact refuse within the receptacle 22, following manual operation of "start" button 28 in FIG. 1, the screws 26 are rotated by an electrical drive motor (not shown) in a direction to move the ram 24 downward into the receptacle 22. As the ram begins to compact refuse within the receptacle 22, the back pressure of the refuse on the ram 24 slows the motor until a centrifugal switch (not shown) mechanically coupled to the motor closes to reverse the direction of the motor and thereby return the ram to its rest position above the receptacle. A number of electrically interlocking switches deenergize the motor at the end of the compaction cycle as well as upon an occurrence of an open or tilted receptacle, or of a jam during movement of the ram 24, in a known manner.

A "full bag" indicator lamp 30 on the cabinet 12 of the refuse compactor is energized and latched on when the receptacle is determined to be full. The full condition of the receptacle 22 is detected by a limit switch 32 mounted on a rear wall 34 of the cabinet. The limit switch 32 has an operator or throw 36 (see FIG. 3) that is contacted by a contact member 38 extending from the rear portion of the ram 24 when the ram is located within the receptacle at a position corresponding to a "full bag". Accordingly, if the limit switch 32 is closed at the time the drive motor reverses, indicating that the ram has compacted refuse within a full bag, the receptacle 22 is determined to be full, and the "full bag" indicator 30 is energized.

Determination of a full receptacle by a simultaneous closure of the limit switch 32 and motor centrifugal switch is made more clear with reference to FIGS. 4A–4C and 5A–5C.

Figure 4A:
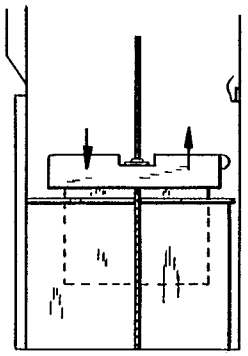
FIGS. 4A–4C show the operation of the ram and limit switch when the refuse receptacle is not full.
Figure 4B:
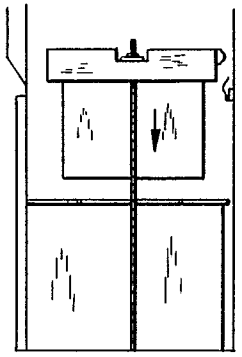
Figure 4C:
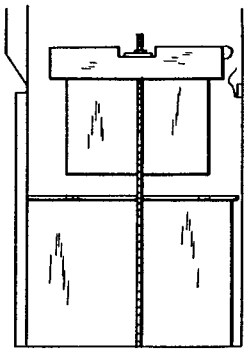

In FIGS. 4A–4C, a sequence of movements of the ram 24 is carried out with the bag or receptacle not full of refuse. The ram 24 is driven downward by the drive motor in FIG. 4A, past the limit switch 32. The limit switch 32 is momentarily closed, but the motor centrifugal switch does not become closed to reverse the ram until the ram is below the limit switch 32 in the position shown in FIG. 4B. The ram 22 now returns to its rest position above the limit switch 32, again momentarily closing the limit switch. At no time during the cycle shown in FIG. 4A–4C are the limit switch and centrifugal switch closed simultaneously.

Figure 5A:
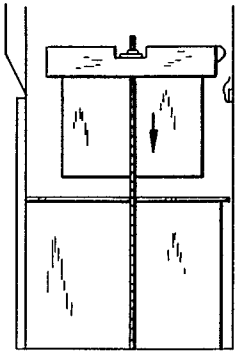
FIGS. 5A–5C show the operation of the ram and limit switch when the refuse receptacle is full.
Figure 5B:
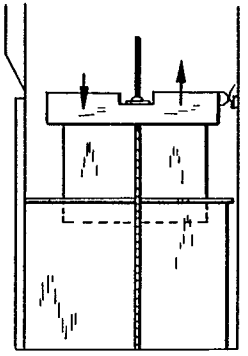
Figure 5C:
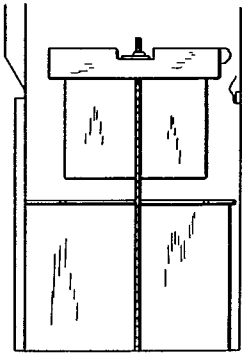

In FIGS. 5A–5C, however, the ram 22 driven downward in FIG. 5A is reversed at the position shown in FIG. 5B, corresponding to a full bag or receptacle, to return the ram to its rest position shown in FIG. 5C. With the limit switch 32 and motor centrifugal switch closed simultaneously when the ram 22 is in the position shown in FIG. 5B, the indicator lamp 30 on the cabinet 12 of the refuse compactor is energized.

Figure 3:
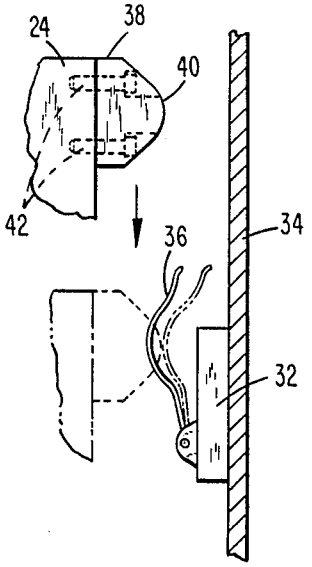
FIG. 3 shows contact between the ram and limit switch other during downward movement of the ram into the receptacle.

The contact member 38 extending from the ram 24 is configured with an arcuate contact surface 40, as shown in FIG. 3, to slide along the arcuate switch operator 36, and close the switch 32 as the ram reciprocates during each compaction cycle. The member 38 preferably is secured to the ram 24 by bolts 42, and the rear wall 34 is spaced from the ram 24 by a distance sufficient to provide contact between the switch operator 36 and contact member 38. The location of switch 32 on the rear wall 34 as provided herein is more economically installed and substantially less prone to failure than one suspended from upper surface 14 of the compactor as in U.S. Pat. No. 3,831,513, supra.

A first embodiment 44 of a circuit for controlling the ram 24 as well as the full bag indicator 30, during a compaction cycle of operation, comprises a "hot" line 46 and a neutral line 48 connectable to a power supply at $L_1$, $L_2$ for applying current to motor 52 coupled to ram drive screws 26 (FIG. 2). Motor 52, which is a conventional reversible A.C. motor, includes a run winding 50 and a pair of start windings 52*a*, 52*b* energized, selectively, by a double pole, double throw top limit-directional switch 60 and a centrifugal switch 64 mechanically coupled to the motor. The centrifugal switch 64 conventionally is a double pole-double switch which closes when the rate of rotation of motor is greater than a predetermined rate; only one half-section of the switch is used in the embodiment of FIG. 6.

A receptacle safety switch 54, a run switch 56 and start switch 58 are connected in series with wire 46 and run winding 50 of motor 52. A receptacle tilt switch 62 is connected in series with one throw 60a of the top limit-directional switch 60.

The operation of switches 54, 58, 60 and 62, within a compactor control circuit of a type known in the prior art, is described in Miller et al U.S. Pat. No. 4,062,282, assigned to the assignee of this invention. During a compaction cycle, throws 60*a*, 60*b* of the switch 60 are in the positions shown by solid lines in FIG. 6, and throw 64*a* of centrifugal switch 64 is closed when the ram 24 is in its "rest" position above the receptacle 22. As the start switch 58 is manually closed by the user, cw (clockwise) start winding 50 of motor 52 is energized by supply L1, L2 through wires 66, 67, 69, 71 and 73, and simultaneously run winding 50 is energized through wire 66 to drive ram 24 downward into receptacle 22, to compress refuse therein. As the ram descends downward, centrifugal switch 64 opens to deenergize the start winding 52*a*, and the throws 60*a*, 60*b* of top limit switch 60 switch into the positions shown in dotted lines in FIG. 6.

As the decent of the ram 24 and the speed of rotation of the motor 52 slow upon compaction of refuse in the receptacle 22, centrifugal switch 64 again closes, applying a current to counterclockwise start winding 52*b* through wires 66, 67, 75, 71 and 73 while run winding 50 remains energized through wire 66 to reverse the direction of the motor and return the ram 24 to its rest position above the receptacle.

Switch 32, closed by ram contact member 38 (FIG. 3) when the ram is in a position within the receptacle corresponding to a "full bag" is in series with an actuator coil 68*a* of a relay 68 having normally open throws 68*b*, 68*c*. The first throw 68*b*, when closed while centrifugal switch 64 is also closed, energizes "full bag" indicator lamp 30 by passing current through a series circuit consisting of switches 54, 56, lamp 30 and switch 68*b* and 64. The second throw 68*c* of relay 68 latches the lamp 30 on by electrically bypassing switches 64 and 32, so that the lamp 30 remains energized independent of the position of the ram 24 or of movement of motor 52, until the relay 68 is manually reset by the user momentarily opening a reset switch 70 in series with actuator coil 68*a*.

Figure 7:
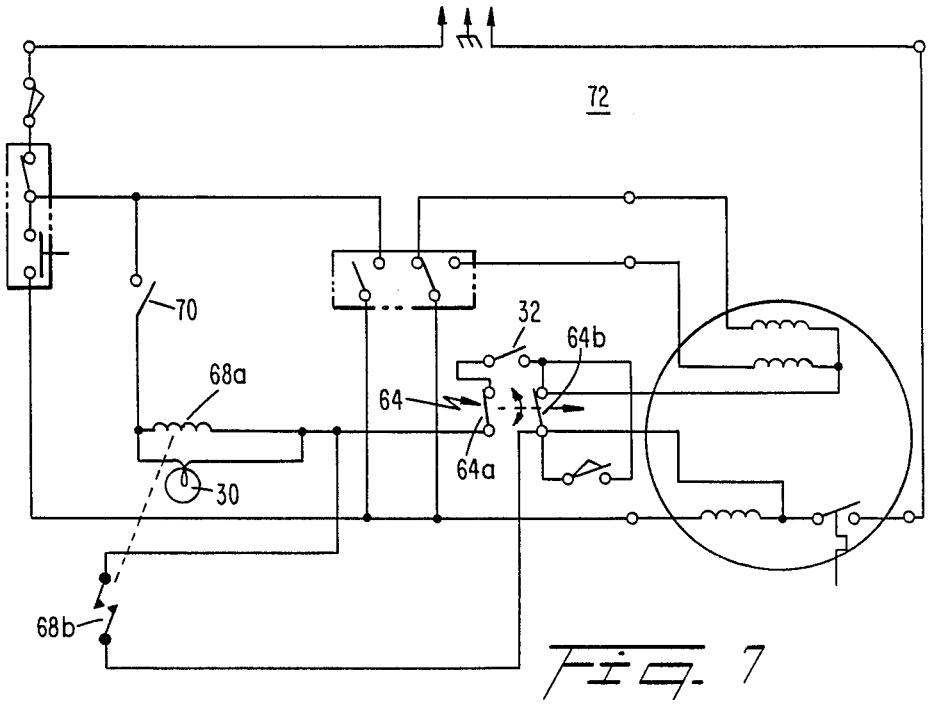
FIG. 7 is a circuit diagram of the compactor control and full bag display, in accordance with another embodiment of the invention.

In the embodiment of FIG. 7, circuit 72 eliminates the second set of relay contacts 68*c* by connecting "full bag" limit switch 32 in series with both existing throws 64*a*, 64*b* of centrifugal switch 64, and connecting indicator lamp 30 in parallel with actuator relay 68*a*. When limit switch 32 is closed while centrifugal switch throws 64*a*, 64*b*, are also closed, indicating that the refuse bag 24 is full, lamp 30 and relay actuator coil 68*a* are both energized. The actuator coil 68*a* closes relay contacts 68*b* which bypasses the switches 32, 64 to latch the lamp 30 on.

Figure 6:
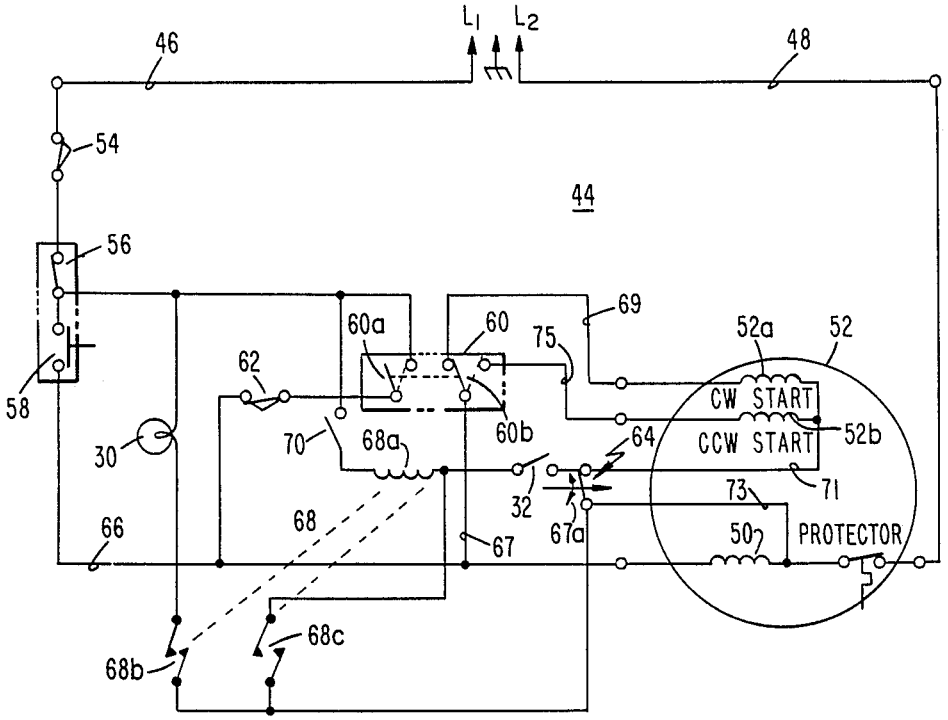
FIG. 6 is a circuit diagram of the compactor control and full bag display, in accordance with one embodiment of the invention.

The lamp 30 thus is controlled by the "full bag" limit switch 32 and motor centrifugal switch 64 of circuits 44 and 72 to become energized and latched on when the direction of movement of motor 52 is reversed by centrifugal switch 64 simultaneously with closure of limit switch 32 by contact 38 member of the ram 24. Switch 32 is advantageously located on an inner wall 34 of the cabinet 12, to be operated by contact member 38 of ram 24 as the ram is driven downward on screws 26 to compact refuse. In the circuit of FIG. 6, the full bag indicator relay is latched on by a second pair of contacts 68*c* that, when closed, bypasses the full bag limit switch 32 and centrifugal switch 64. In FIG. 7, the second pair of contacts 68*c* of lamp relay 68 is eliminated by connecting throw 68*b* electrically in series with the actuator coil 68*a*; the additional throw 64*b* of the centrifugal switch 64 required in this embodiment is already extant within the conventional switch.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. In a refuse compactor having a cabinet, a receptacle in the cabinet for refuse, a ram, means for supporting the ram for movement between a first position above and out of contact with any refuse in the receptacle and a second position to compress refuse therein, an electrically operated reversible drive means for moving said ram between said first and second positions and circuit means connectable to a power source for energizing said drive means to move said ram from the first position into the second position to compress refuse in said receptacle and then retract said ram into said first position, said circuit means including first manually operable switch means for selectively energizing said drive means and second switch means responsive to a reduction of speed of said drive means as said ram compresses said refuse for reversing the direction of said drive means;

an improvement wherein said circuit means further includes a "full receptacle" display located on said cabinet and third switch means located on a wall of said cabinet to be operated by said ram when said ram is in a position corresponding to a full receptacle, and wherein said first, second and third switch means and said display are connected electrically in series with each other to energize said display;

wherein said circuit means further includes means for latching on said display in response to a closure of said first, second and third switch means.

2. The improvement of claim 1, including a relay having a first pair of normally open contacts electrically in series with said display and an actuator coil energized in response to a closure of said first, second and third switch means to close said first pair of contacts.

3. The improvement of claim 2, wherein said actuator coil is connected electrically in series with said first, second and third switch means.

4. The improvement of claim 3, wherein said display is connected electrically in parallel with said actuator coil.

5. The improvement of claim 3, wherein said relay has a second pair of normally open contacts electrically bypassing said second and third switch means to latch on said display.

6. The improvement of claim 1, including a contact member extending radially from a portion of said ram to contact said third switch means.

7. In a refuse compactor having a cabinet, a receptacle in the cabinet for refuse, a ram, means for supporting the ram for movement between a first position above and out of contact with any refuse in the receptacle and a second position to compress refuse therein, an electrically operated reversible motor having a "run" winding for moving said ram between said first and second positions and a "start" winding for starting or changing the direction of said motor, and circuit means connectable to a power source for energizing said motor to move said ram from the first position into the second position to compress refuse in said receptacle and then retract said ram into said first position, said circuit means including first manually operable switch means for energizing the "run" and "start" windings of said motor and second switch means responsive to a reduction of speed of said motor as said ram compresses said refuse for energizing said "start" winding to reverse the direction of said motor;

an improvement wherein said circuit means further includes a "full receptacle" lamp located on said cabinet and third switch means located on a wall of said cabinet to be operated by said ram when said ram is in a position corresponding to a full receptacle, and wherein said first, second and third switch means and said lamp are connected electrically in series with each other to energize said lamp;

wherein said circuit means further includes means for latching on said lamp in response to a closure of said first, second and third switch means.

8. The improvement of claim 7, including a relay having a first pair of normally open contacts electrically in series with said lamp and an actuator coil energized in response to a closure of said first, second and third switch means to close said first pair of contacts.

9. The improvement of claim 8, wherein said actuator coil is connected electrically in series with said first, second and third switch means.

10. The improvement of claim 9, wherein said lamp is connected electrically in parallel with said actuator coil.

11. The improvement of claim 9, wherein said relay has a second pair of normally open contacts electrically bypassing said second and third switch means to latch on said lamp.

12. The improvement of claim 7, including a contact member extending radially from a portion of said ram to contact said third switch means.

* * * * *